United States Patent [19]

Richardson et al.

[11] Patent Number: 4,497,610

[45] Date of Patent: Feb. 5, 1985

[54] SHROUD ASSEMBLY FOR A GAS TURBINE ENGINE

[75] Inventors: David A. Richardson, Mickleover; Michael H. Coney, Littleover, both of England

[73] Assignee: Rolls-Royce Limited, London, England

[21] Appl. No.: 467,078

[22] Filed: Feb. 16, 1983

[30] Foreign Application Priority Data

Mar. 23, 1982 [GB] United Kingdom ..... 8208494

[51] Int. Cl.[3] ..... F01D 11/08

[52] U.S. Cl. ..... 415/116; 415/117; 415/175; 415/200

[58] Field of Search ..... 415/115–117, 415/174, 175, 200, 108, 128

[56] References Cited

U.S. PATENT DOCUMENTS

| | | | |
|---|---|---|---|
| 3,423,070 | 1/1969 | Corrigan | 415/200 |
| 3,694,255 | 9/1972 | Brill-Edwards | 415/200 |
| 3,800,864 | 4/1974 | Hauser | 415/115 |
| 3,963,368 | 6/1976 | Emmerson | 415/116 |
| 4,050,843 | 9/1977 | Needham | 415/116 |
| 4,127,357 | 11/1978 | Patterson | 415/116 |
| 4,177,004 | 12/1979 | Riedmiller | 415/116 |
| 4,251,185 | 2/1981 | Karstensen | 415/174 |
| 4,273,824 | 6/1981 | McComas | 415/200 |

FOREIGN PATENT DOCUMENTS

| | | | |
|---|---|---|---|
| 1308771 | 3/1973 | United Kingdom | 415/116 |

OTHER PUBLICATIONS

Principles of Engineering Heat Transfer, by Warren H. Giedt, Ph.D., Section 1.3, including pp. 4, 5, 6 and 7.

*Primary Examiner*—Samuel Scott
*Assistant Examiner*—Brian J. Bowman
*Attorney, Agent, or Firm*—Cushman, Darby & Cushman

[57] ABSTRACT

A shroud assembly for a gas turbine engine consists of a housing having a boundary wall and a gas contacting skin, the wall and skin being in segmented form. The skin consists of a thin metal sheet attached to the boundary wall, and a ceramic gas contacting coating. The skin is impingement cooled by cooling air flowing through apertures in the boundary wall, and the cooling air exhausts into the gas flow through passages.

The use of a thin metal sheet with a ceramic coating promotes favorable temperature gradients in the skin enabling the coating to run at optimum conditions for maximum cooling effect.

6 Claims, 3 Drawing Figures

SHROUD ASSEMBLY FOR A GAS TURBINE ENGINE

Figure 1:
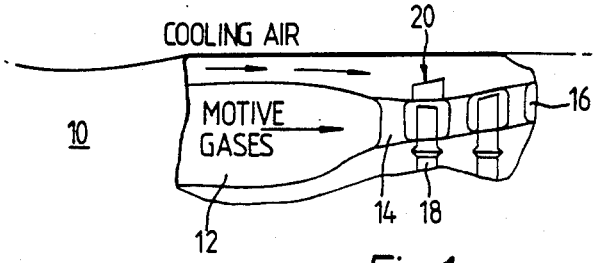

This invention relates to shroud assemblies for gas turbine engines and is more particularly concerned with shroud assemblies for the turbine or turbines of such engines.

The trend for improving gas turbine engine performance in terms of power output and efficiency continues. A well established method of performance improvement involves increasing the temperature of the motive gases, which in turn requires that special attention be paid to those components which are contacted by these gases. For example, the blades and vanes of the engine turbine and the walls which define the gas path may need a supply of cooling air, or they may need to be made of a particular material or to be of a particular structural form, or they may need to have a combination of any of these features.

In the case of turbine shroud assemblies, such assemblies need to maintain a small clearance between the shroud and the rotating turbine at all operating conditions in order to keep turbine efficiency at a maximum. A general form of design which provides for the cooling of the hot gas contacting part of the shroud and enables the shroud to respond to keep the shroud and turbine clearance to a minimum, involves the use of a plenum chamber, a temperature controlling flow of air and a gas contacting shroud portion. The shroud assembly is constructed and supported so as to have thermal response characteristics which are similar to those of the turbine, and the plenum chamber is arranged to receive a flowing of cooling air to discharge the cooling air to cool the gas contracting part of the shroud. The cooling may be by impingement or by transpiration, and a ceramic coating may be applied to the surface of the gas contracting shroud part.

The present invention proposes a shroud assembly of a design similar to that discussed above but modified to provide a number of significant advantages. In particular, the amount of cooling air required to maintain a specific shroud temperature may be reduced, or the same cooling air flow may be used to reduce the shroud temperature.

Accordingly, the present invention provides a shroud assembly for a gas turbine engine, the assembly comprising a shroud having a housing arranged to receive a flow of cooling fluid and to discharge the cooling fluid through apertures in a boundary wall of the housing, and a skin which in part defines an annular passage for the throughflow of motive gases, the outer surface of the skin being in contact with the motive gases and the inner surface of the skin being impinged by the flow of cooling fluid from the shroud housing, the cooling fluid being exhausted between the boundary wall and the skin adjacent the downstream end of the shroud assembly, the skin being attached to and relatively less stiff than the boundary wall, the skin comprising an inner thin metallic layer and an outer layer of ceramic coating.

The boundary wall may include a number of ribs to which the skin is attached, the number, size and spacing of the ribs being such as to minimise distortion of the skin under gas and thermal loading.

The boundary wall may be a casting and the skin may comprise a thermal barrier coating on a metal sheet, e.g. magnesium zirconate or a stabilised zirconia a Nimonic alloy sheet.

The boundary wall may also have further cooling air apertures which discharge cooling air into the motive gas flow at the upstream end of the wall.

In one embodiment, the boundary wall and the respective skins are formed as a number or arcuate segments which are butted together and held by securing means to form a ring.

Figure 2:
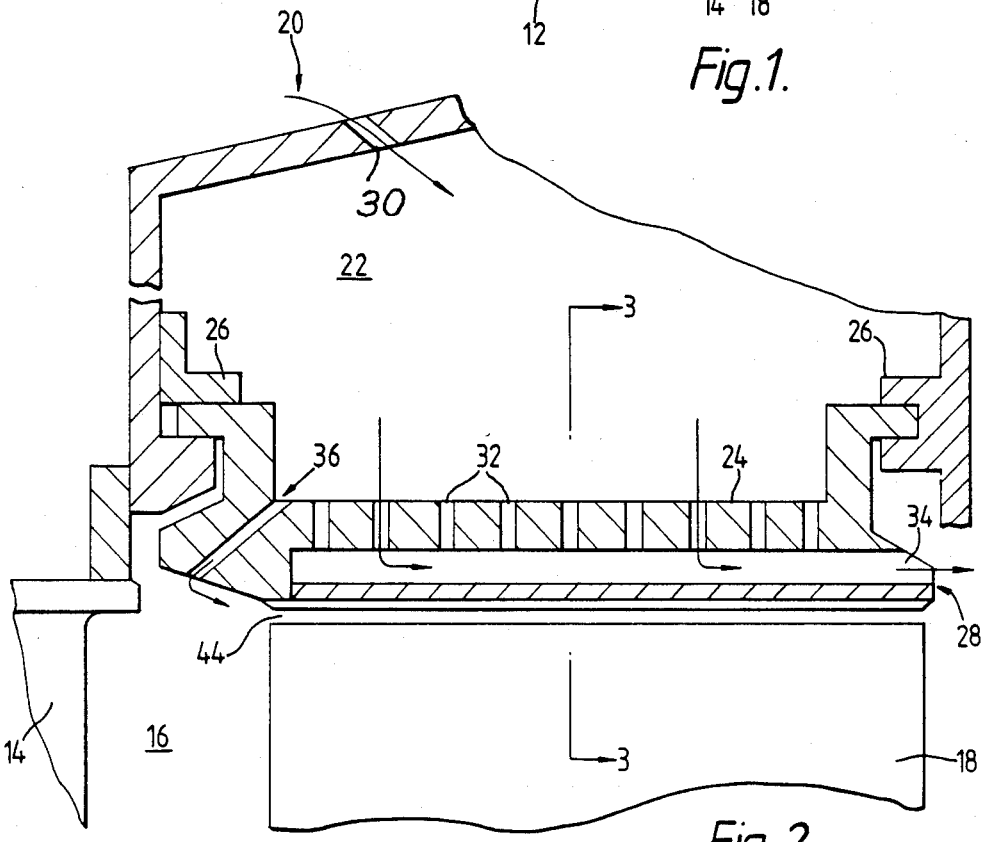
Figure 3:
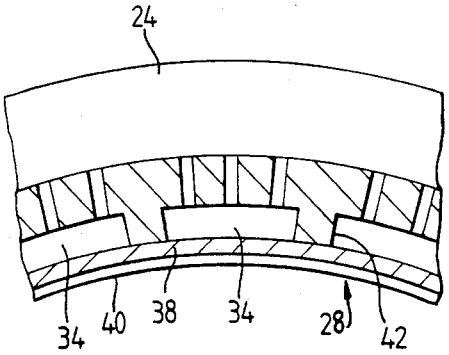

The present invention will now be more particularly described with reference to the accompanying drawing in which:

FIG. 1 shows diagrammatically, a part of a gas turbine engine incorporating a shroud assembly according to the present invention, FIG. 2 is a sectional elevation of the shroud assembly of FIG. 1 to a larger scale, and FIG. 3 is a section on line 3—3 in FIG. 2.

Referring to the figures a gas turbine engine 10, only a part of which is shown, includes a combustor 12 discharging motive gases via a ring of nozzle guide vanes 14 into an annular passage 16 which contains a high pressure turbine 18. A shroud assembly 20 surrounds the turbine 18 with a small running clearance being provided between the tips of the blades of the turbine and the shroud assembly. A supply of cooling air is taken from the engine compressor to cool the shroud assembly as will be described below.

The assembly 20 comprises a housing 22 and a boundary wall 24 held in position by securing means 26 and having a skin 28. The housing receives the cooling air through openings 30 and the cooling air is discharged through apertures 32 to impinge upon the inner face of the skin. The used cooling air is discharged into the gas annulus 16 through passages 34, and if desired, some cooling air may be discharged through openings 36 in the boundary wall at its upstream end.

The skin 28 comprises a layer 38 of metal sheet, e.g. a Nimonic alloy and a thermal barrier coating 40, e.g. magnesium zirconate or a stabilised zirconia. The skin is attached to longitudinal ribs 42 which are cast integrally with the boundary wall, the number, size and spacing of the ribs being such as to minimise distortion of the skin when in use.

Although not shown in detail, the boundary wall and skin is divided up into a number of arcuate segments which are butted together and held by the securing means 26 to form a ring around the turbine 18, with a clearance 44 between the turbine blades and segments.

As compared with known forms of shroud assembly in which the impingement cooling is onto a relatively thick wall, the corresponding wall of the present invention is the skin 28 which is relatively thin, and which enables the Biot number effects to be exploited, the Biot number being an indication of the ratio of thermal conductance at the surface to the thermal conductivity of a material. The use of a thin metal sheet means that the ceramic coatings employed, are provided with optimum running conditions for maximum cooling effect, because of the favourable temperature gradients in the ceramic and the metal sheet.

The invention enables a smaller flow of cooling air to be used to maintain a particular temperature in the shroud, or the same flow of cooling air can be used to maintain the shroud at a particular temperature if the motive gas temperature is increased.

If blade rub should occur between the blades and the skin, the ceramic coating provides an abradable coating, and in the extreme case of the skin becoming detached, the shroud segment reverts to pure film cooling. The segment can then be repaired fairly easily by brazing on a new skin.

We claim:

1. A shroud assembly for a gas turbine engine comprising: a housing defined in part by a relatively thick and stiff boundary wall member, said boundary wall member having apertures for through flow of a cooling fluid, said boundary wall member further having a plurality of projections extending away from said housing, and a skin attached to said projections of said boundary wall member to define a plurality of spaces therewith into which said cooling fluid flows from said apertures in said boundary wall member, said skin defining in part an annular passage in the gas turbine engine for through flow of motive gases, said skin comprising an inner relatively thin, flexible metallic layer as compared to said boundary wall member and an outer layer of ceramic coating for contact by said motive gases, said boundary wall member and said skin further defining outlet passages for exhausting said cooling fluid adjacent a downstream end of the shroud assembly.

2. An assembly as claimed in claim 1 in which said projections comprise at least two ribs to which are attached said skin, spacing of said ribs being such as to keep distortion of said skin to a minimum.

3. An assembly as claimed in claim 1 in which said boundary wall member is a casting, said thin inner metallic layer is a sheet and said ceramic coating is a thermal barrier coating.

4. An assembly as claimed in claim 1 in which said boundary wall member includes further cooling fluid apertures which are arranged to discharge said cooling fluid into the flow of motive fluid upstream of said skin.

5. An assembly as claimed in claim 1 in which said boundary wall member and said respective skin are in a form a number of arcuate segments, ends of said arcuate segments being butted together to form a ring.

6. A turbine section for a gas turbine engine including a bladed rotor and said shroud assembly as claimed in any one of claims 1, 2, 3, 4 or 5, said shroud assembly being spaced outwardly of said bladed rotor and closely spaced therefrom.

* * * * *